US011146000B2

(12) United States Patent
Ho

(10) Patent No.: US 11,146,000 B2
(45) Date of Patent: Oct. 12, 2021

(54) ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/021,062

(22) Filed: Sep. 15, 2020

(65) Prior Publication Data

US 2021/0226362 A1 Jul. 22, 2021

(30) Foreign Application Priority Data

Jan. 22, 2020 (CN) ..... 202010075096.3

(51) Int. Cl.

| | |
|---|---|
| ***H01R 9/22*** | (2006.01) |
| ***H01R 12/57*** | (2011.01) |
| ***H01R 4/02*** | (2006.01) |
| ***H01R 12/52*** | (2011.01) |

(52) U.S. Cl.

CPC ..... *H01R 12/57* (2013.01); *H01R 4/02* (2013.01); *H01R 12/52* (2013.01)

(58) Field of Classification Search

CPC ..... H01R 12/52; H01R 12/55; H01R 12/57; H01R 4/02; H01R 4/029

USPC ..... 439/709

See application file for complete search history.

(56) References Cited

U.S. PATENT DOCUMENTS

2021/0226362 A1* 7/2021 Ho ..... H01R 4/02

FOREIGN PATENT DOCUMENTS

| | | |
|---|---|---|
| CN | 109193222 A | 1/2019 |
| CN | 209133725 U | 7/2019 |
| TW | M516257 U | 1/2016 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical connector is used to mate with an electronic component having a conductor. The electrical connector includes an insulating body having an accommodating hole, and a terminal accommodated in the accommodating hole. A protruding portion protrudes from a first wall of the accommodating hole. An elastic arm of the terminal has a main body portion. A pre-pressurized portion and a contact portion of the elastic arm respectively have a first contact end and a second contact end. The second contact end is located closer to the main body portion than the first contact end. Prior to the first contact end abutting the protruding portion, a horizontal projection of the first contact end along an insertion direction at least partially overlaps with a horizontal projection of the protruding portion along the insertion direction and passes beyond a horizontal projection of the second contact end along the insertion direction.

12 Claims, 10 Drawing Sheets

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202010075096.3 filed in China on Jan. 22, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector mounted on a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is used to be conductively connected to an electronic component. The electronic component is provided with multiple conductive holes, and a metal layer is coated in each of the conductive holes. The electrical connector includes an insulating body and multiple terminals provided in the insulating body. The terminals are electrically connected to the electronic component and a circuit board respectively. Each terminal has a main body portion and a contact portion protruding from the main body, and the contact portion is used to be in contact with the metal layer. When the electronic component moves downward to mate with the electrical connector, the contact portion enters a corresponding conductive hole of the electronic component to be in contact with the metal layer, thus facilitating the electrical connection between the electrical connector and the electronic component.

Generally, a sufficient abutting force is required between each terminal and the corresponding metal layer to ensure stable contact therebetween. For each terminal, if the abutting force is provided by an elastic force generated by the elastic deformation of the terminal when the metal layer mates with the terminal, it is required to provide a larger stroke for the elastic deformation of the terminal. Thus, a distance between a contact end of the contact portion and the main body portion is longer. Meanwhile, the overall size of each terminal is also larger to adapt with the contact portion, such that the terminal has sufficient structural strength. Thus, the overall size of the electrical connector becomes correspondingly larger, which is not conducive to miniaturization thereof. Therefore, an existing terminal is provided with a pre-pressurized portion protruding from the main body portion and located below the contact portion, which performs a pre-pressurized force accumulation before the terminal mates with the metal layer, to reduce the stroke for the elastic deformation of the terminal, thereby reducing the size of the contact portion, and reducing the overall size of the terminal and the electrical connector.

However, in a process for the existing terminal having the pre-pressurized portion to be inserted into the insulating body, the contact portion may easily be in contact with the insulating body and be applied with a larger abutting force by the insulating body, such that the contact portion scrapes the insulating body deeply, and insulating debris generated by the insulating body sticks to the contact portion, thus affecting the stable contact between the terminal and the electronic component.

Therefore, a heretofore unaddressed need to design a novel electrical connector exists in the art to address the aforementioned deficiencies and inadequacies.

SUMMARY

The present invention is directed to an electrical connector, in which the contact portion of the terminal is located closer to the main body portion relative to the pre-pressurized portion, such that in a process for the terminal to be inserted into the insulating body, the abutting force applied to the contact portion by the insulating body is less relative to the abutting force applied to the pre-pressurized portion, thereby solving the issue where the contact portion scrapes the insulating body deeply.

To achieve the foregoing objective, the present invention adopts the following technical solutions. An electrical connector is configured to mate with an electronic component having a conductor. The electrical connector includes: an insulating body, having an accommodating hole, wherein the accommodating hole has a first wall, and a protruding portion protrudes from the first wall; and a terminal, accommodated in the accommodating hole, wherein the terminal has an elastic arm, the elastic arm has a main body portion, a pre-pressurized portion and a contact portion located above the pre-pressurized portion and configured to mate with the conductor, the pre-pressurized portion and the contact portion both protrude from the main body portion toward one side of the protruding portion, the pre-pressurized portion has a first contact end away from the main body portion, the contact portion has a second contact end away from the main body portion, and the second contact end is located closer to the main body portion than the first contact end; wherein in a process for the terminal to be inserted into the accommodating hole, and prior to the first contact end abutting the protruding portion, a direction for the terminal to be inserted into the accommodating hole is defined as an insertion direction, and a horizontal projection of the first contact end along the insertion direction at least partially overlaps with a horizontal projection of the protruding portion along the insertion direction and passes beyond a horizontal projection of the second contact end along the insertion direction; and wherein in a process for the first contact end to abut the protruding portion, the main body portion elastically deviates toward a direction away from the protruding portion.

In certain embodiments, the protruding portion has an abutting surface perpendicular to a protruding direction of the protruding portion, a guiding portion is provided on at least one of the pre-pressurized portion and the first wall, and in the process for the terminal to be inserted into the accommodating hole, and prior to the first contact end abutting the protruding portion, the main body portion inclines upward from bottom thereof toward the protruding portion, and the guiding portion guides the pre-pressurized portion to the abutting surface.

In certain embodiments, in the process for the terminal to be inserted into the accommodating hole, and prior to the first contact end abutting the protruding portion, the horizontal projection of the second contact end along the insertion direction and the horizontal projection of the protruding portion along the insertion direction are staggered.

In certain embodiments, the terminal has a base, the main body portion is located above the base, a plate surface of the main body portion bends relative to a plate surface of the base, and in a process for the second contact end to mate with the conductor, a direction of elastic deformation of the main body portion is perpendicular to the plate surface of the base.

In certain embodiments, the elastic arm has an extending portion extending upward from the plate surface of the base, and a bending portion bending from a side of a plate surface of the extending portion, the plate surface of the main body portion is perpendicular to the plate surface of the extending portion, the pre-pressurized portion and the contact portion both protrude from one side of a plate edge of the main body portion, a plate surface of the pre-pressurized portion and a plate surface of the contact portion are both parallel to the plate surface of the main body portion, and a movement direction of the first contact end and the second contact end is perpendicular to the plate edge of the main body portion.

In certain embodiments, the accommodating hole has a second wall opposite to the first wall, the terminal has a base, two sides of the base respectively have two positioning portions extending upward and configured to position the terminal, a plate surface of the main body portion is opposite to a plate surface of the base and a plate surface of each of the positioning portions respectively, a bottom surface of the insulating body is upward concavely provided with a positioning slot to accommodate the positioning portions, the positioning slot has a guiding wall, the guiding wall and the second wall are located at a same side of the terminal, and the guiding wall is located farther away from the first wall than the second wall.

In certain embodiments, the protruding portion has an abutting surface, the second contact end abuts the abutting surface, a lower end of the protruding portion is provided with a stopping portion protruding from the abutting surface, a guiding portion is provided between the stopping portion and the first wall, in the process for the first contact end to abut the protruding portion, the guiding portion guides the pre-pressurized portion to the stopping portion, and then the first contact end is located above the stopping portion and abuts the abutting portion, and after the second contact end mates with the conductor, the pre-pressurized portion and a horizontal projection of the stopping portion along the insertion direction partially overlap to stop the pre-pressurized portion from moving downward.

In certain embodiments, the terminal has a base and a fixing portion extending downward from the base, the main body portion is located above the base, the fixing portion has a horizontal projection area along the insertion direction, and after the second contact end mates with the conductor, at least a portion of the horizontal projection of the first contact end along the insertion direction is located outside the horizontal projection area, and at least a portion of the horizontal projection of the second contact end along the insertion direction is located within the horizontal projection area.

Further, an electrical connector is configured to mate with an electronic component having a conductor. The electrical connector includes: an insulating body, having an accommodating hole, wherein the accommodating hole has a first wall, and a protruding portion protrudes from the first wall; and a terminal, accommodated in the accommodating hole, wherein the terminal has an elastic arm, the elastic arm has a main body portion, a pre-pressurized portion and a contact portion located above the pre-pressurized portion and configured to mate with the conductor, the pre-pressurized portion and the contact portion both protrude from the main body portion toward one side of the protruding portion, the pre-pressurized portion has a first contact end away from the main body portion, the contact portion has a second contact end away from the main body portion, and the second contact end is located closer to the main body portion than the first contact end; wherein in a process for the terminal to be inserted into the accommodating hole, an abutting force applied to the second contact end by the protruding portion prior to the first contact end abutting the protruding portion is less than an abutting force applied to the first contact end in a process for the first contact end to abut the protruding portion.

In certain embodiments, the protruding portion has an abutting surface perpendicular to a protruding direction of the protruding portion, a guiding portion is provided on at least one of the pre-pressurized portion and the first wall, and in a process for the terminal to be inserted into the accommodating hole, and prior to the first contact end abutting the protruding portion, the main body portion inclines upward from bottom thereof toward the protruding portion, and the guiding portion guides the pre-pressurized portion to the abutting surface.

In certain embodiments, in the process for the terminal to be inserted into the accommodating hole, and prior to the first contact end abutting the protruding portion, the abutting force by the protruding portion is not applied to the second contact end.

In certain embodiments, the terminal has a base and a fixing portion extending downward from the base, the main body portion extends upward from the base, a direction for the terminal to be inserted into the accommodating hole is defined as an insertion direction, the fixing portion has a horizontal projection area along the insertion direction, and after the second contact end mates with the conductor, a horizontal projection of the main body portion along the insertion direction is completely located within the horizontal projection area.

Compared with the related art, the electrical connector according to certain embodiments of the present invention has the following beneficial effects.

The first contact end is located closer to the protruding portion relative to the second contact end, and the second contact end is located closer to the main body portion relative to the first contact end. In the process for the terminal to be inserted into the accommodating hole, and prior to the first contact end abutting the protruding portion, the horizontal projection of the first contact end along the insertion direction at least partially overlaps with the horizontal projection of the protruding portion along the insertion direction and passes beyond the horizontal projection of the second contact end along the insertion direction, such that the abutting force applied to the second contact end by the protruding portion prior to the first contact end abutting the protruding portion is less than the abutting force applied to the first contact end in the process for the first contact end to abut the protruding portion. Using the abutting force applied to the first contact end as a reference standard, it is more convenient to design and control the abutting force applied to the second contact end, thus facilitating reducing the abutting force applied to the second contact end by the protruding portion when the terminal is inserted into the insulating body, thereby reducing the scraping depth by the second contact end to the insulating body, reducing insulating debris generated by the insulating body, and enhancing the contact stability between the second contact end and the conductor.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
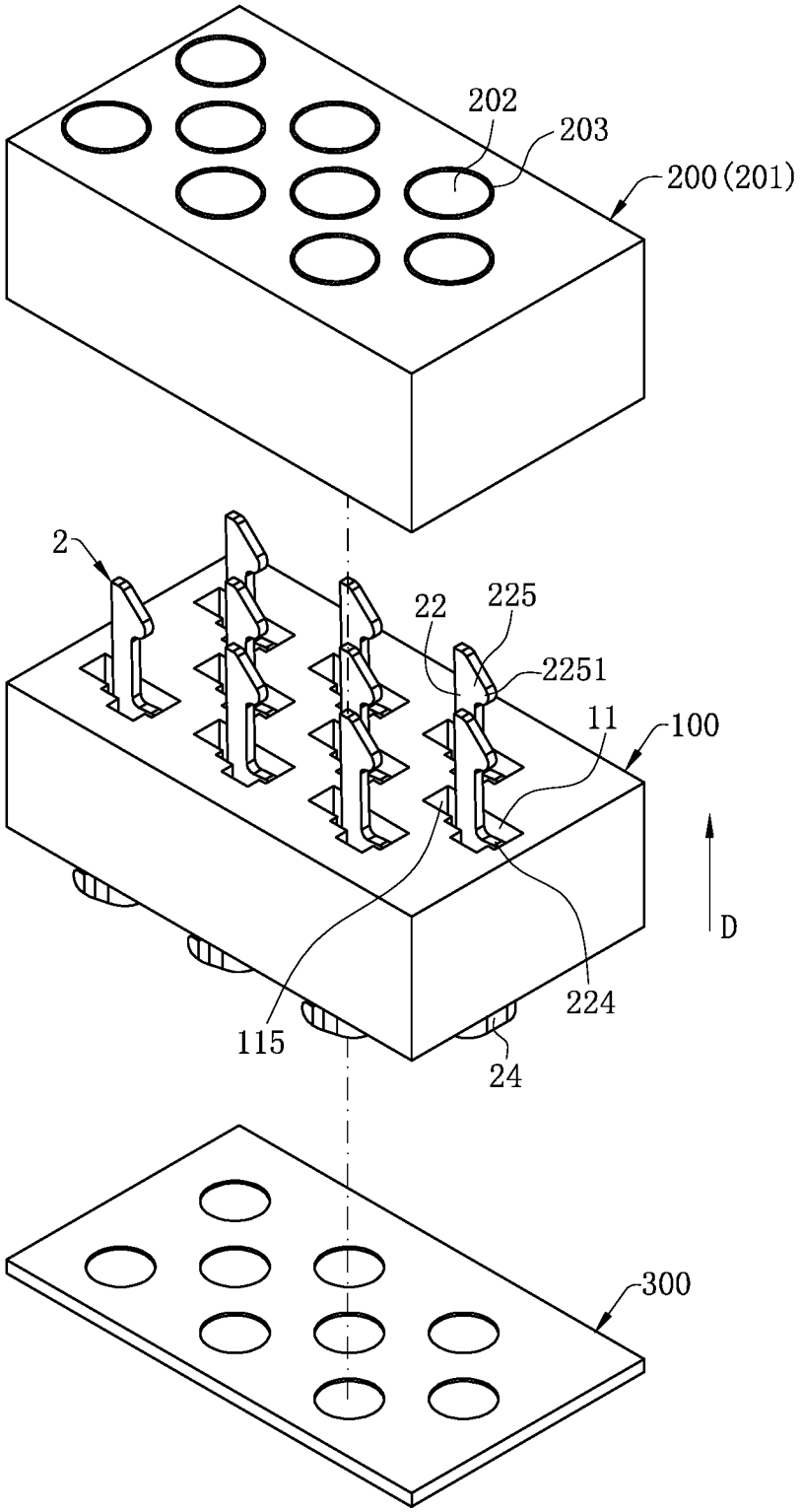
FIG. 1 is a perspective exploded view of an electrical connector, an electronic component and a second circuit board according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector.

Figure 5:
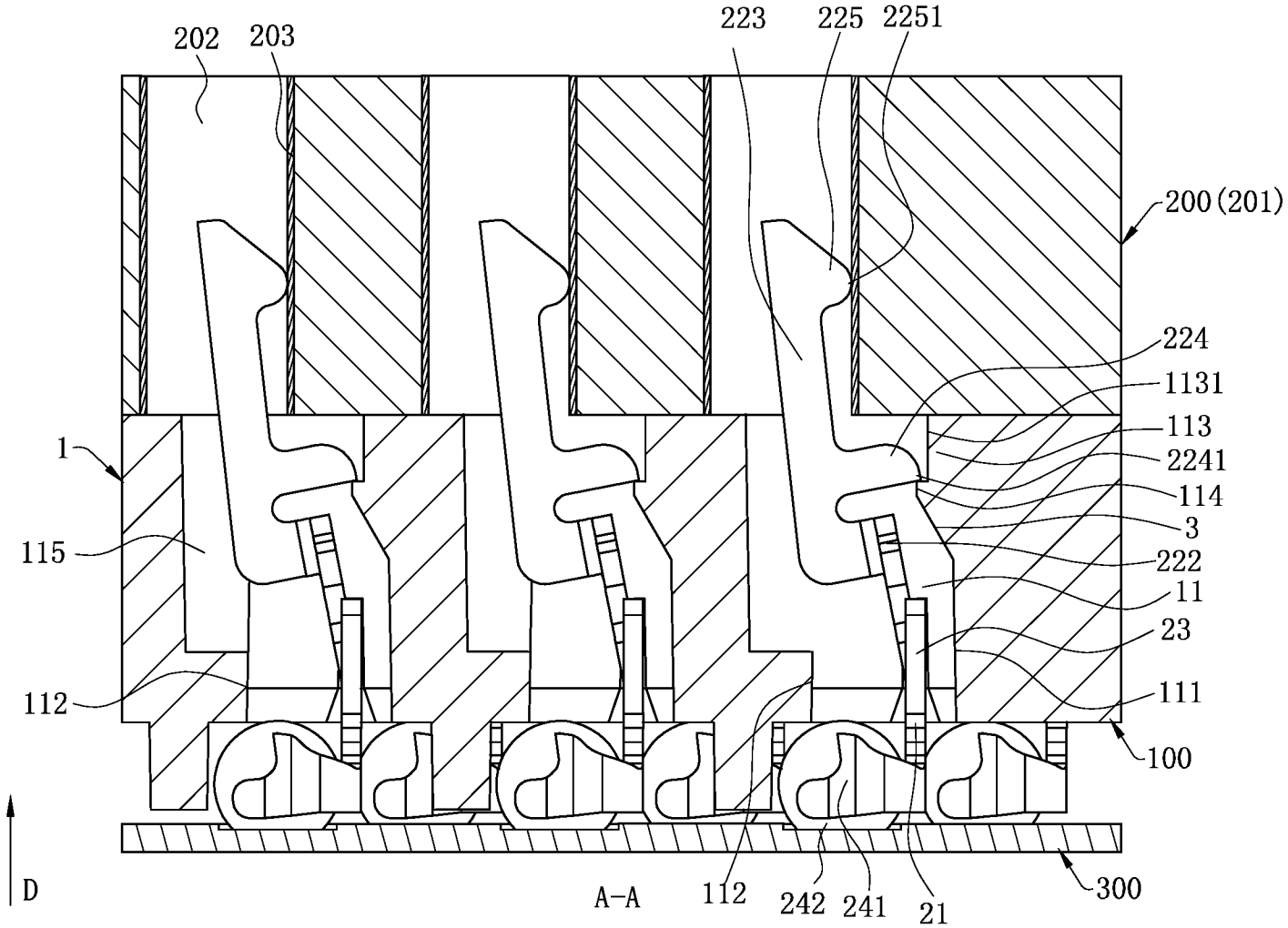
FIG. 5 is a partial sectional view of FIG. 3 along a line A-A.

FIG. 1 and FIG. 5 show an electrical connector 100 according to a first embodiment of the present invention. The electrical connector 100 is an IC-socket type connector, which is used to be electrically connected to an electronic component 200.

The electronic component 200 is a first circuit board 201, and the first circuit board 201 is used to be connected to a chip module (not shown) and to connect the chip module to the electrical connector 100. The electrical connector 100 is mounted on a second circuit board 300, thus facilitating electrical connection between the first circuit board 201 and the second circuit board 300 by the electrical connector 100. In other embodiments, the electronic component 200 may be other types of electronic component 200.

Figure 3:
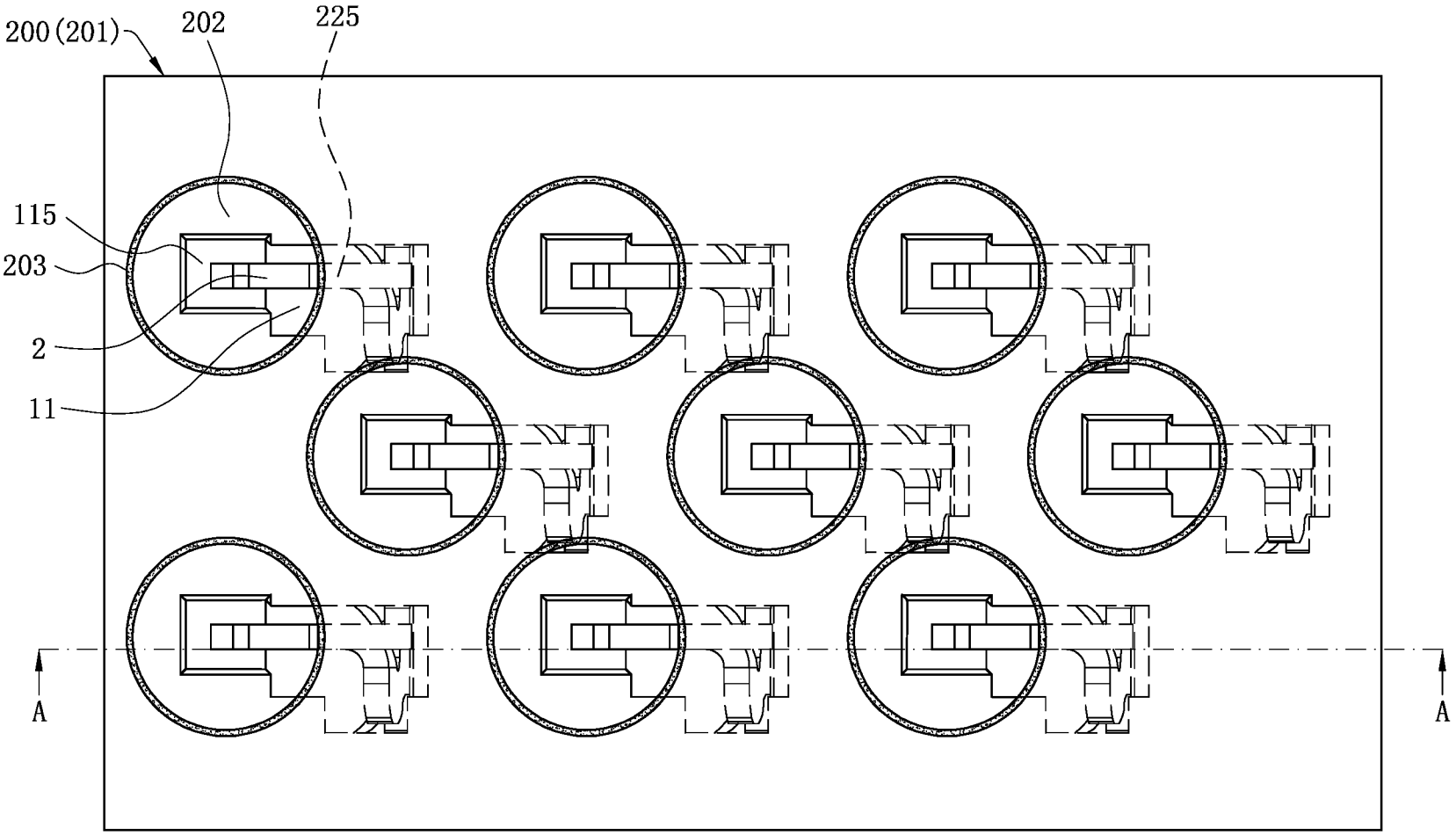
FIG. 3 is a top view of the electrical connector, the electronic component and the second circuit board after being assembled according to the first embodiment of the present invention.

As shown in FIG. 1, FIG. 3 and FIG. 5, the electronic component 200 has a conductive hole 202 and a conductor 203, and the conductor 203 is located on the conductive hole 202. The conductor 203 is a metal layer, and the metal layer is coated on the conductive hole 202. In other embodiments, the conductor 203 may be a metal sheet or an electrically conductive material, such as a conductive ceramic, which is provided on the conductive hole 202 by various methods such as electroplating or interference fit.

Figure 6:
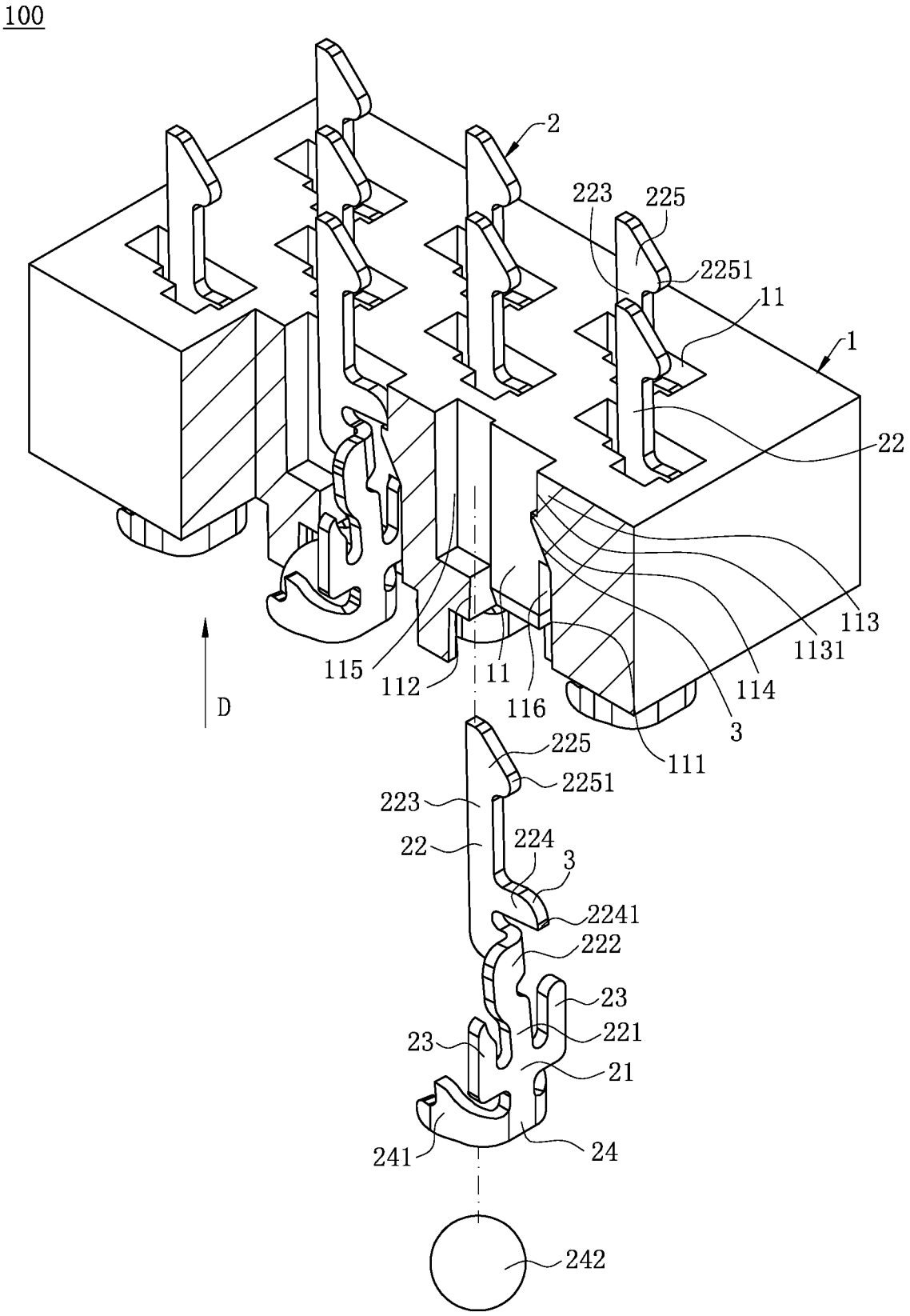
FIG. 6 is a partial sectional view of the electrical connector according to the first embodiment of the present invention.

As shown in FIG. 1, FIG. 5 and FIG. 6, the electrical connector 100 includes an insulating body 1 and a plurality of terminals 2. The insulating body 1 has a plurality of accommodating holes 11 to accommodate the terminals 2. Each accommodating hole 11 has a first wall 111 and a second wall 112 opposite to the first wall 111. A protruding portion 113 protrudes from the first wall 111. The protruding portion 113 has an abutting surface 1131 perpendicular to a protruding direction of the protruding portion 113. A lower end of the protruding portion 113 has a stopping portion 114 protruding from the abutting surface 1131. A guiding portion 3 is located between the stopping portion 114 and the first wall 111, and the guiding portion 3 is a guiding inclined surface.

Figure 4:
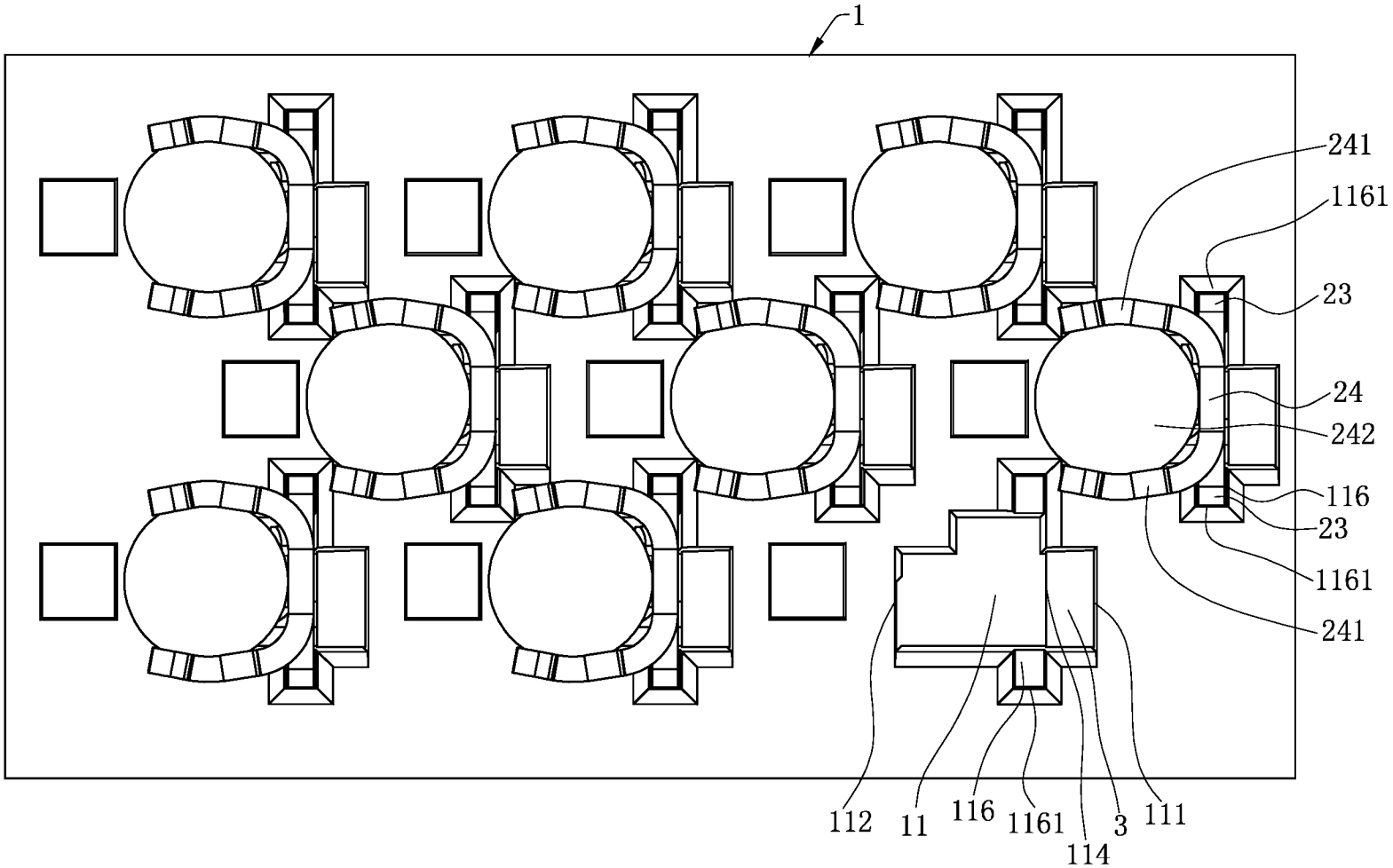
FIG. 4 is a bottom view of FIG. 3 with the second circuit board being removed.

As shown in FIG. 4, FIG. 5 and FIG. 6, the terminals 2 are inserted into the accommodating holes 11 upward from bottom thereof. For convenience of description, a direction for each terminal 2 to be inserted into a corresponding accommodating hole 11 is defined as an insertion direction D. Each terminal 2 has a base 21, an elastic arm 22 extending upward from the base 21, two positioning portions 23 respectively extending upward from two sides of the base 21 to position the terminal 2, and a fixing portion 24 extending downward from the base 21. A bottom surface of the insulating body 1 is upward concavely provided with a positioning slot 116 to accommodate the positioning portions 23. The positioning slot 116 is used to position the positioning portions 23, thereby positioning the terminal 2, and preventing the terminal 2 from deviating in the process for the terminal 2 to be inserted into the insulating body 1 and affecting the mounting of the terminal 2 and the electrical contact between the terminal and the corresponding conductor 203. The second wall 112 is concavely provided with a reserved space 115 reserved for the elastic arm 22 to deform when the terminal 2 is mated with the corresponding conductor 203.

Figure 2:
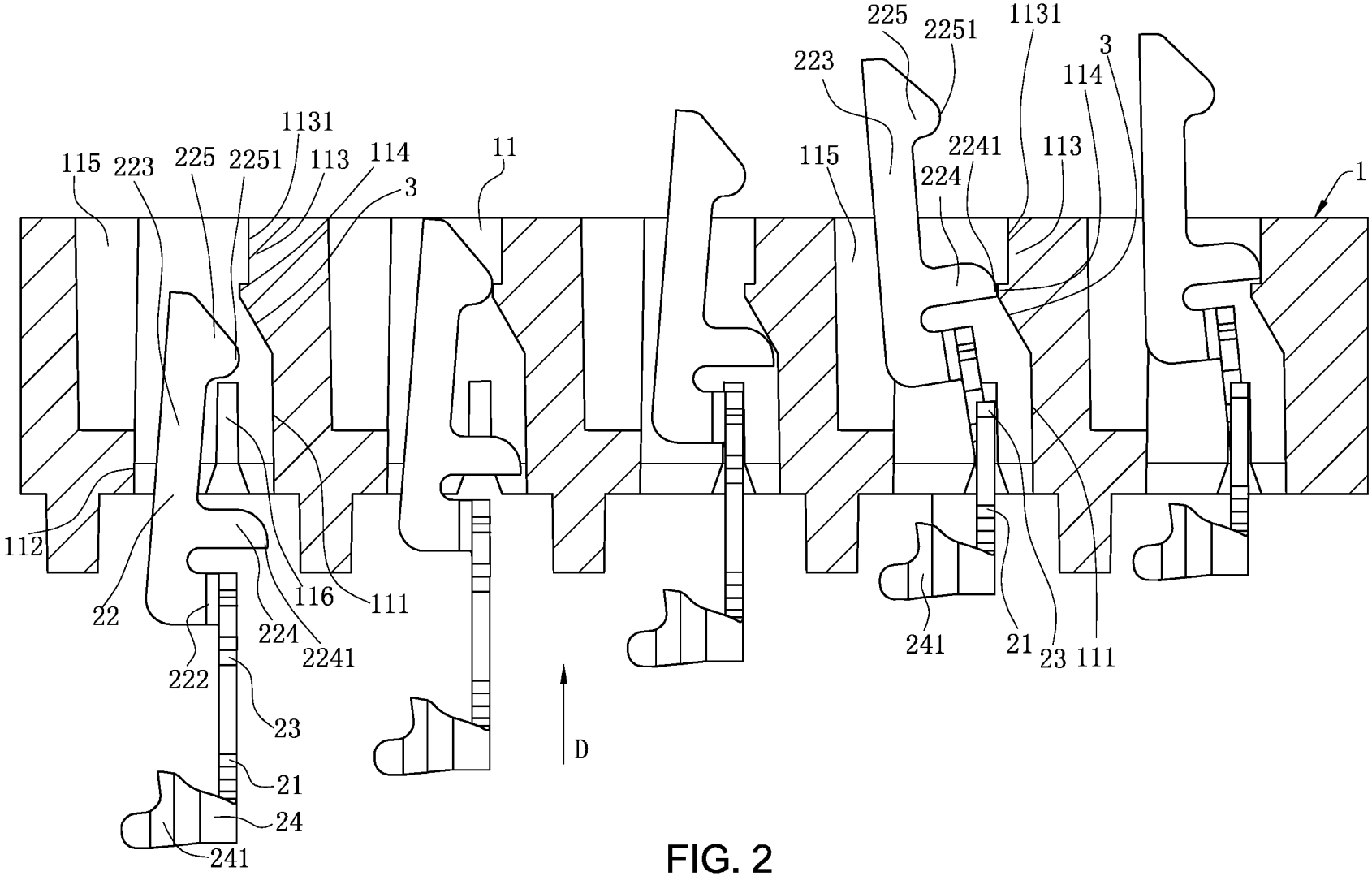
FIG. 2 is a structural schematic view of terminals being assembled to an insulating body according to the first embodiment of the present invention.

As shown in FIG. 2, FIG. 5 and FIG. 6, the elastic arm 22 has an extending portion 221 extending upward along a plate surface of the base 21, a bending portion 222 bending from one side of a plate surface of the extending portion 221, a main body portion 223 extending upward from a tail end of the bending portion 222, a pre-pressurized portion 224 and a contact portion 225 located above the pre-pressurized portion 224 and used to mate with the corresponding conductor 203. The pre-pressurized portion 224 and the contact portion 225 both protrude from the main body portion 223 toward one side of the protruding portion 113. The bending portion 222 is used to reserve for the positioning portions 23, such that the positioning slot 116 is formed in the insulating body 1 to position and fix the positioning portions 23. A plate surface of the main body portion 223 is perpendicular to the plate surface of the extending portion 221, and the plate surface of the main body portion 223 bends relative to the plate surface of the base 21. The contact portion 225 is located at an upper end of the main body portion 223, and the main body portion 223 does not abut the wall of the conductive hole 202 when the contact portion 225 is mated with the corresponding conductor 203, thus preventing the main body portion 223 from abutting the conductive hole 202 during the elastic deformation process and being applied with an abutting force, preventing the contact portion 225 and the main body portion 223 from being applied with the force and deforming, and preventing the stable contact between the contact portion 225 and the conductor 203 from being affected. The pre-pressurized portion 224 and the contact portion 225 both protrude from one side of a plate edge of the main body portion 223, utilizing the structural strength of the plate edge of the main body portion 223 to strengthen the contact strength of the terminal 2, such that the pre-pressurized portion 224 has sufficient strength to support the terminal 2, preventing the pre-pressurized portion 224 and the contact portion 225 from easily deforming due to the abutting force from the protruding portion 113 or the conductor 203. The plate surfaces of the pre-pressurized portion 224 and the contact portion 225 are both parallel to the plate surface of the main body portion 223 to further strengthen the strength of the pre-pressurized portion 224 and the contact portion 225, allowing the pre-pressurized portion 224, the contact portion 225 and the main body portion 223 to be formed integrally by blanking, such that consistency of the force applied to the pre-pressurized portion 224 and the contact portion 225 is better, facilitating the contact stability between the pre-pressurized portion 224 and the contact portion 225. The pre-pressurized portion 224 is located above the bending portion 222, and a distance between the pre-pressurized portion 224 and the bending portion 222 is less than a width of the bending portion 222. A plate edge of the bending portion 222 and a plate edge of the pre-pressurized portion 224 are opposite to each other, such that when the pre-pressurized portion 224 abuts the abutting surface 1131, the bending portion 222 provides sufficient structural strength to prevent the main body portion 223 from being applied with force and deforming. Further, by filleting and chamfering between the pre-pressurized portion 224 and the bending portion 222, when the pre-pressurized portion 224 abuts the abutting surface 1131, the stress generated between the pre-pressurized portion 224 and the bending portion 222 is reduced.

As shown in FIG. 2, FIG. 5 and FIG. 6, the pre-pressurized portion 224 has a first contact end 2241 away from the main body portion 223. The contact portion 225 has a second contact end 2251 away from the main body portion 223 and a guiding inclined surface guiding the conductor 203 to the second contact end 2251. The movement direction of the first contact end 2241 and the second contact end 2251 is perpendicular to the plate edge of the main body portion 223, such that the direction of the abutting force applied to the first contact end 2241 and the second contact end 2251 from the protruding portion 113 or the conductor 203 is perpendicular to the plate edge of the main body portion 223, and the plate edge of the main body portion 223 is applied with force. In this case, when the main body portion 223 performs elastic deformation, the elastic deformation amount is not excessive. By having the plate surface of the main body portion 223 perpendicular to the plate surface of the extending portion 221, the direction of the abutting force applied to the first contact end 2241 and the second contact end 2251 from the protruding portion 113 or the conductor 203 is perpendicular to the plate surface of the extending portion 221. Compared to the plate edge of the extending portion 221, the elasticity of the plate surface of the extending portion 221 is better, such that the extending portion 221 has better elasticity to increase the elasticity of the elastic arm 22, resulting in a smaller resisting force when the second contact end 2251 is mated with the conductor 203. The guiding portion 3 is further provided on the pre-pressurized portion 224, such that the pre-pressurized portion 224 is easily guided to the abutting surface 1131, thereby reducing the insertion force of the terminal 2. In other embodiments, the guiding portion 3 may be provided only on the pre-pressurized portion 224 or the protruding portion 113.

As shown in FIG. 2, the second contact end 2251 is located closer to the main body portion 223 relative to the first contact end 2241. In the process for the terminal 2 to be inserted into the accommodating hole 11, and prior to the first contact end 2241 abutting the protruding portion 113, the main body portion 223 of the terminal 2 inclines upward from bottom thereof toward the protruding portion 113, the horizontal projection of the first contact end 2241 along the insertion direction D at least partially overlaps with the horizontal projection of the protruding portion 113 along the insertion direction D, and the horizontal projection of the second contact end 2251 along the insertion direction D and the horizontal projection of the protruding portion 113 along the insertion direction D are staggered, thus preventing the second contact end 2251 from scraping the insulating body 1 in the insertion process, preventing the insulating body 1 from generating insulating debris that sticks to the second contact end 2251, and thereby preventing from affecting the stable connection between the second contact end 2251 and the conductor 203. Since the diameter of the conductive hole 202 in this embodiment is 0.55 mm, which has a small space, the corresponding size of the terminal 2 is also provided to be small. Thus, this embodiment adopts the single-sided contact method, that is, the terminal 2 is only provided with one contact portion 225 to be conductively connected with the conductor 203, thus ensuring the structural strength of the terminal 2, preventing the terminal 2 from deforming during mounting and mating with the conductor 203 and affecting the normal usage of the terminal 2. Since only one contact portion 225 is provided, it may easily cause insufficient contacting and abutting force between the contact portion 225 and the conductor 203. Thus, to ensure the stable contact between the contact portion 225 and the conductor 203, the main body portion 223 is provided to be a structure inclined toward the protruding portion 113 upward from bottom thereof, thus satisfying the miniaturization size and increasing the elastic margin of the main body portion 223, increasing the abutting force applied to the conductor 203 by the contact portion 225, such that the contact between the contact portion 225 and the conductor 203 is more stable. Further, under the same force applying condition, the location of the main body portion 223 after elastic deviation is closer to the first wall 111, such that the accommodating hole 11 may be provided smaller, and the abutting surface 1131 is perpendicular to the protruding direction of the protruding portion 113, facilitating reducing the distance between the main body portion 223 and the first wall 111. In addition, the main body portion 223 is a structure inclined toward the protruding portion 113, the overall size of the terminal 2 is smaller, and the second contact end 2251 is easily in contact with the protruding portion 113. In this case, the main body portion 223 may easily be applied with a downward acting force, causing the elastic arm 22 to be applied with a larger acting force, thus damaging the elastic structure of the elastic arm 22, affecting the elastic deformation of the elastic arm 22, such that after the terminal 2 is mounted to the insulating body 1, the location of the second contact end 2251 of the contact portion 225 changes, affecting the stable contact between the contact portion 225 and the conductor 203, affecting the mounting of the terminal 2, and causing the terminal 2 to deform and fail by being applied with an excessive force. Thus, the second contact end 2251 is located closer to the main body portion 223 relative to the first contact end 2241, and when the terminal 2 is inserted into the insulating body 1, the first contact end 2241 is located closer to the protruding portion 113 relative to the second contact end 2251. In other words, the first contact end 2241 is longer than the second contact end 2251, thus reducing the abutting force applied to the second contact end 2251 by the protruding portion 113 in the process for the terminal 2 to be inserted into the insulating body 1.

In other embodiments, the horizontal projection of the second contact end 2251 along the insertion direction D and the horizontal projection of the protruding portion 113 along the insertion direction D may partially overlap, and the horizontal projection of the first contact end 2241 along the insertion direction passes beyond the horizontal projection of the second contact end 2251 along the insertion direction D. In this case, the first contact end 2241 is located closer to the protruding portion 113 relative to the second contact end 2251, such that the abutting force applied to the second contact end 2251 by the protruding portion 113 prior to the first contact end 2241 abutting the protruding portion 113 is less than the abutting force applied to the first contact end 2241 in the process for the first contact end 2241 to abut the protruding portion 113. Using the abutting force applied to the first contact end 2241 as a reference standard, it is more convenient to design and control the abutting force applied to the second contact end 2251, thus facilitating reducing the abutting force applied to the second contact end 2251 by the protruding portion 113 when the terminal 2 is inserted into the insulating body 1, thereby reducing the scraping depth by the second contact end 2251 to the insulating body 1, reducing insulating debris generated by the insulating body 1, and enhancing the contact stability between the second contact end 2251 and the conductor 203.

As shown in FIG. 2, in the process for the first contact end 2241 to abut the stopping portion 114 of the protruding portion 113, the guiding portion 3 guides the pre-pressurized portion 224 to the stopping portion 114. In this case, the main body portion 223 elastically deviates toward a direction away from the protruding portion 113, and then the first contact end 2241 is located above the stopping portion 114 and abuts the abutting surface 1131. In this case, the stopping portion 114 is used to stop the pre-pressurized portion 224 and to prevent the pre-pressurized portion 224 from moving downward during mounting and causing the terminal 2 not to be mounted in place. After the second contact end 2251 is mated with the conductor 203, the pre-pressurized portion 224 and the horizontal projection of the stopping portion 114 along the insertion direction D partially overlap to prevent the pre-pressurized portion 224 from moving downward along the insertion direction D and causing ill contact between the second contact end 2251 and the conductor 203. In other embodiments, after the second contact end 2251 is mated with the conductor 203, the pre-pressurized portion 224 and the horizontal projection of the stopping portion 114 along the insertion direction D are staggered, thus preventing the terminal 2 from moving downward by relying upon the supporting force provided by the second circuit board 300 to the terminal 2.

Figure 7:
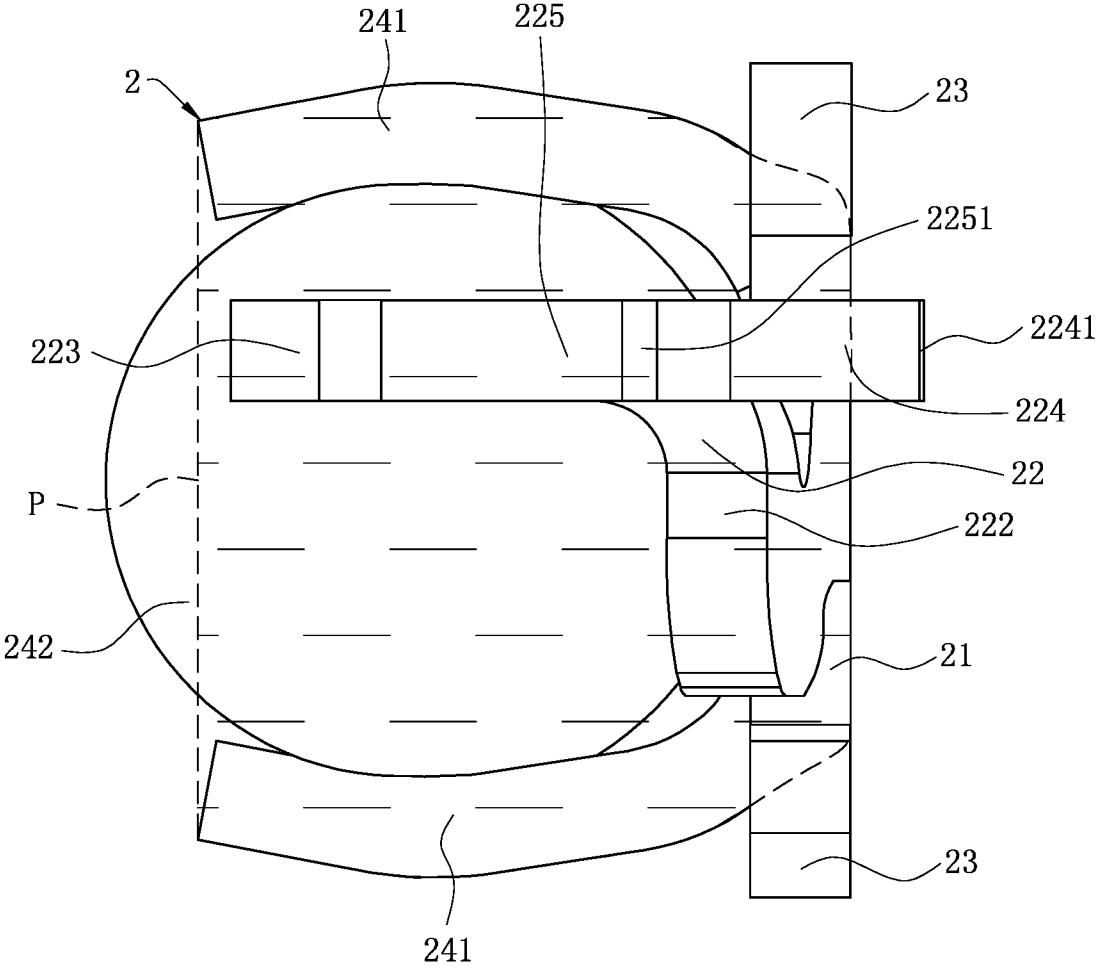
FIG. 7 is a top view of a terminal according to the first embodiment of the present invention.

As shown in FIG. 6 and FIG. 7, the fixing portion 24 has a horizontal projection area P along the insertion direction D. The horizontal projection area P is a contour for the horizontal projection of the fixing portion 24 along the insertion direction D. The fixing portion 24 has two fixing arms 241 bending and extending corresponding to the two opposite sides of the base 21, and the two fixing arms 241 are used to clamp a solder 242. The solder 242 is located within the horizontal projection area P and soldered onto the second circuit board 300. The horizontal projection of the first contact end 2241 along the insertion direction D is located outside the horizontal projection area P, the horizontal projection of the main body portion 223 along the insertion direction D is completely located within the horizontal projection area P, and the horizontal projection of the second contact end 2251 along the insertion direction D is located within the projection area of the solder 242 along the insertion direction D.

In this case, the first contact end 2241 and the second contact end 2251 are respectively located at two opposite sides of the contour boundary of the fixing portion 24, and the horizontal projection of the first contact end 2241 along the insertion direction D is located outside the horizontal projection of each positioning portion 23 along the insertion direction D, such that a contact position between the first contact end 2241 and the abutting surface 1131 and a contact position between the second contact end 2251 and the conductor 203 are respectively located at the two opposite sides of the contour boundary of the fixing portion 24, and located at two opposite sides of the contour boundary of the positioning portions 23. Thus, the acting forces applied to the first contact end 2241 and the second contact end 2251 by the fixing portion 24 and the positioning portions 23 along the insertion direction D are relatively balanced, such that after the second contact end 2251 is mated with the conductor 203, the fixing and positioning of the terminal 2 are more stable, which does not easily shake, and the contact between the second contact end 2251 and the conductor 203 becomes more stable. Further, the contact position between the second contact end 2251 and the conductor 203 is limited to be within the horizontal projection area P, and the acting force applied to the second contact end 2251 by the fixing portion 24 is larger, such that the contact between the second contact end 2251 and the conductor 203 becomes more stable. Moreover, since the solder 242 is a direct fixing portion and a direct electrical connecting portion between the fixing portion 24 and the second circuit board 300, the acting force applied to the first contact end 2241 and the second contact end 2251 by the solder 242 is larger, such that the terminal 2 is more stable. The projection of the second contact end 2251 along the insertion direction D is located within the projection area of the solder 242 along the insertion direction D, such that when the signal is transmitted to the second circuit board 300 along the second contact end 2251, the consistency of the signal transmission is better.

Further, the horizontal projection of the main body portion 223 along the insertion direction D is completely located with the horizontal projection area P, such that the inclined angle of the main body portion 223 is restricted, and the inclined angle does not become too large, thus preventing the second contact end 2251 from being easily in contact with the protruding portion 113 when the terminal 2 is inserted into the insulating body 1, and further preventing the main body portion 223 from easily deforming and breaking the elastic structure of the main body portion 223. Moreover, when the signal is transmitted along the main body portion 223 to the fixing portion 24, consistency of the signal is better, and the signal does not have an excessive wave to affect the signal transmission. In addition, the overall structure of the terminal 2 may be provided smaller, thus saving space, such that the size of the corresponding matching structure may also be provided smaller, satisfying the miniaturization requirement of the electrical connector 100.

Figure 8:
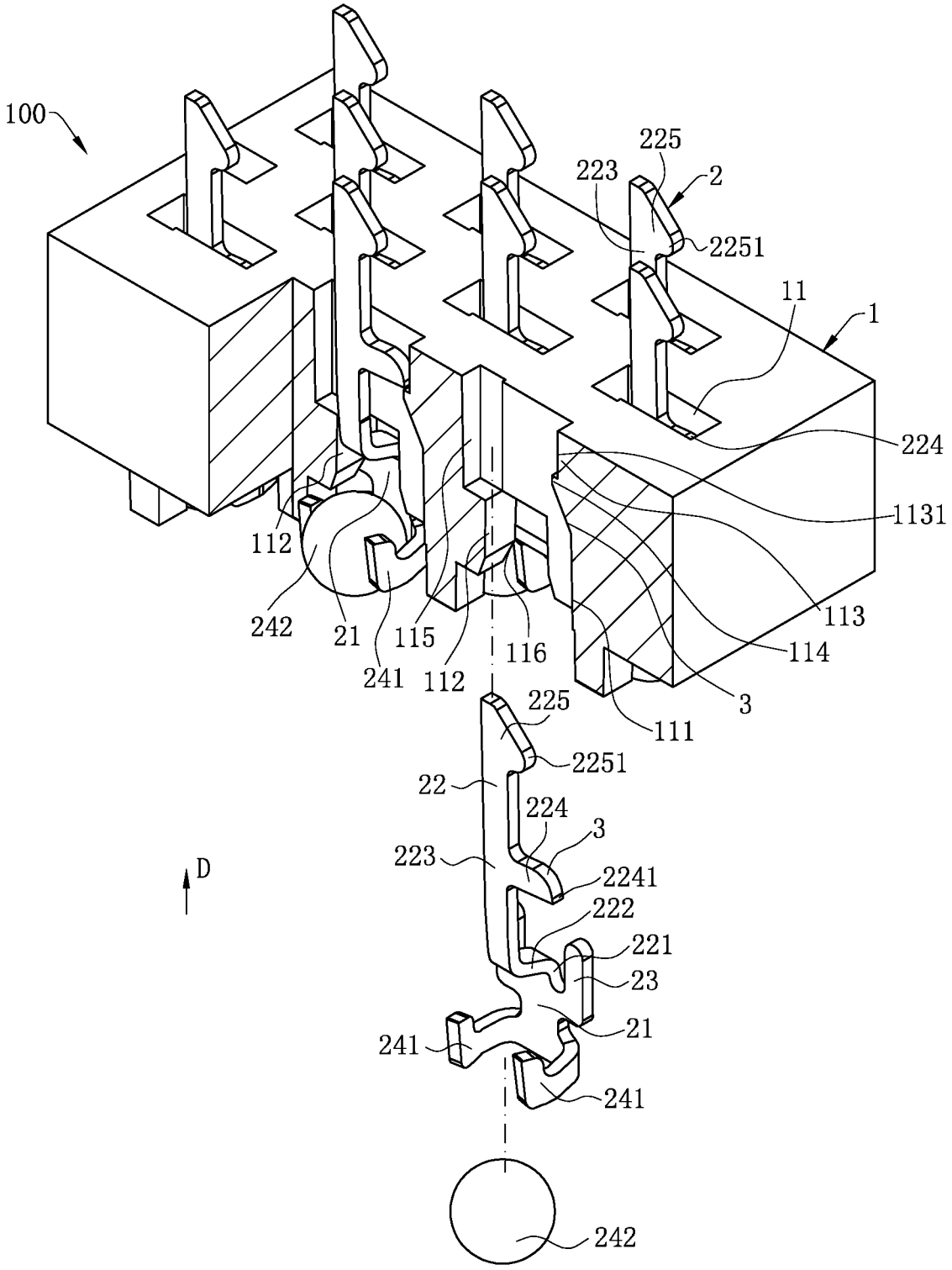
FIG. 8 is a partial sectional view of an electrical connector according to a second embodiment of the present invention.
Figure 9:
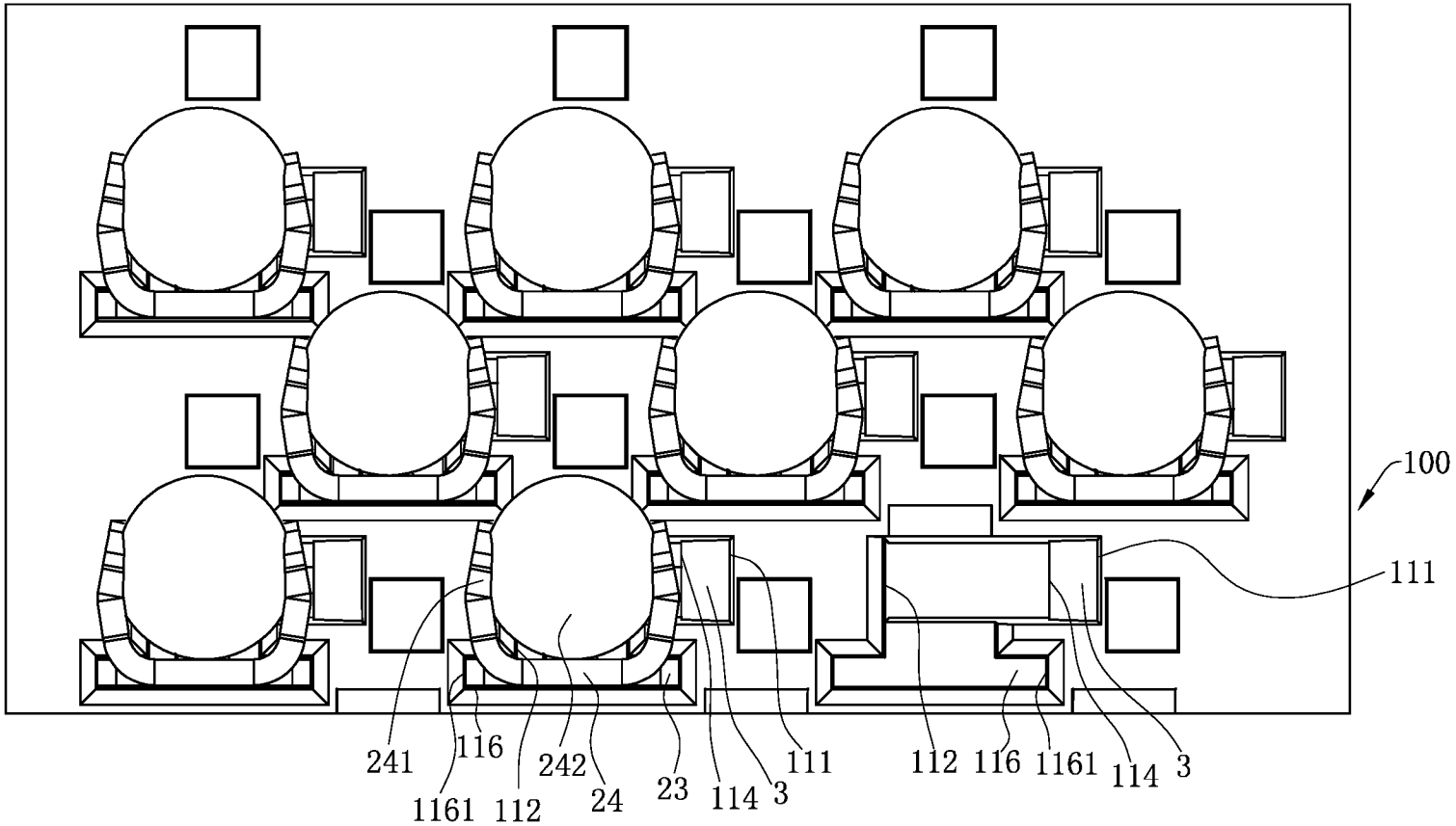
FIG. 9 is a bottom view of the electrical connector and an electronic component after being assembled according to the second embodiment of the present invention.
Figure 10:
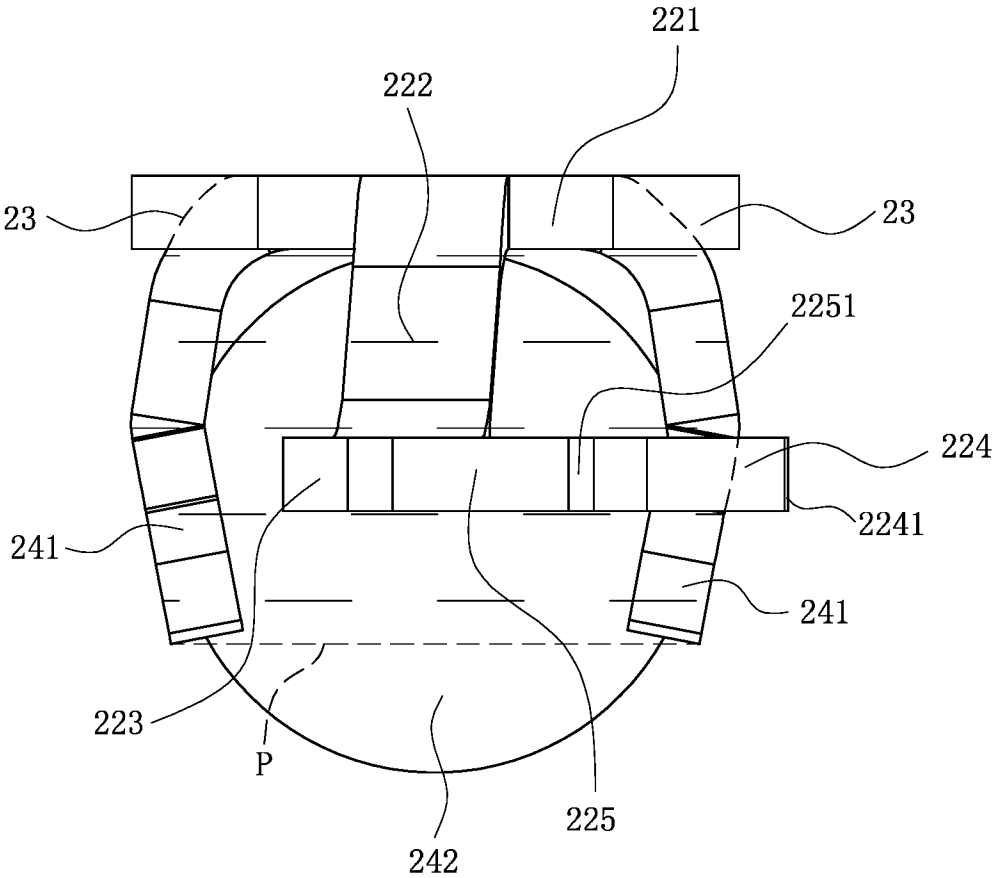
FIG. 10 is a top view of a terminal according to the second embodiment of the present invention.

FIG. 8 to FIG. 10 show an electrical connector 100 according to a second embodiment of the present invention, which is different from the first embodiment in that: the plate surface of the main body portion 223 is opposite and parallel to the plate surface of the base 21 and the plate surface of each positioning portion 23 respectively, the plate edge of the pre-pressurized portion 224 and the plate surface of the bending portion 222 are opposite to each other, the positioning slot 116 has a guiding wall 1161 located at a same side of the terminal 2 with the second wall 112, and the guiding wall 1161 is located farther away from the first wall 111 relative to the second wall 112. The plate surface of the main body portion 223 is opposite and parallel to the plate surface of the base 21 and the plate surface of each fixing portion 23 respectively, such that in the process of signal transmission, when the signal is transmitted along the main body portion 223, the base 21 and the positioning portions 23, the signal transmission direction is consistent and does not change, thus reducing transmission loss, and facilitating the stability and consistency of the signal transmission. The guiding wall 1161 is located farther away from the first wall 111 relative to the second wall 112, thus facilitating the positioning portions 23 to better enter and be positioned in the positioning slot 116, and preventing the positioning portions 23 from detaching from the positioning slot 116.

In sum, the electrical connector 100 according to certain embodiments of the present invention has the following beneficial effects:

(1) The first contact end 2241 is located closer to the protruding portion 113 relative to the second contact end 2251, and the second contact end 2251 is located closer to the main body portion 223 relative to the first contact end 2241. In the process for the terminal 2 to be inserted into the accommodating hole 11, and prior to the first contact end 2241 abutting the protruding portion 113, the horizontal projection of the first contact end 2241 along the insertion direction D at least partially overlaps with the horizontal projection of the protruding portion 113 along the insertion direction D and passes beyond the horizontal projection of the second contact end 2251 along the insertion direction D, such that the abutting force applied to the second contact end 2251 by the protruding portion 113 prior to the first contact end 2241 abutting the protruding portion 113 is less than the abutting force applied to the first contact end 2241 in the process for the first contact end 2241 to abut the protruding portion 113. Using the abutting force applied to the first contact end 2241 as a reference standard, it is more convenient to design and control the abutting force applied to the second contact end 2251, thus facilitating reducing the abutting force applied to the second contact end 2251 by the protruding portion 113 when the terminal 2 is inserted into the insulating body 1, thereby reducing the scraping depth by the second contact end 2251 to the insulating body 1, reducing insulating debris generated by the insulating body 1, and enhancing the contact stability between the second contact end 2251 and the conductor 203.

(2) the main body portion 223 is provided to be a structure inclined toward the protruding portion 113 upward from bottom thereof, thus satisfying the miniaturization size and increasing the elastic margin of the main body portion 223, increasing the abutting force applied to the conductor 203 by the contact portion 225, such that the contact between the contact portion 225 and the conductor 203 is more stable. Further, under the same force applying condition, the location of the main body portion 223 after elastic deviation is closer to the first wall, such that the accommodating hole 11 may be provided smaller, and the abutting surface 1131 is perpendicular to the protruding direction of the protruding portion 113, facilitating reducing the distance between the main body portion 223 and the first wall 111. In addition, the main body portion 223 is a structure inclined toward the protruding portion 113, the overall size of the terminal 2 is smaller, and the second contact end 2251 is easily in contact with the protruding portion 113. In this case, the main body portion 223 may easily be applied with a downward acting force, causing the elastic arm 22 to be applied with a larger acting force, thus damaging the elastic structure of the elastic arm 22, affecting the elastic deformation of the elastic arm 22, such that after the terminal 2 is mounted to the insulating body 1, the location of the second contact end 2251 of the contact portion 225 changes, affecting the stable contact between the contact portion 225 and the conductor 203, affecting the mounting of the terminal 2, and causing the terminal 2 to deform and fail by being applied with an excessive force. Thus, when the terminal 2 is inserted into the insulating body 1, the first contact end 2241 is located closer to the protruding portion 113 relative to the second contact end 2251, thus reducing the abutting force applied to the second contact end 2251 by the protruding portion 113 in the process for the terminal 2 to be inserted into the insulating body 1.

(3) In the process for the terminal 2 to be inserted into the accommodating hole 11, and prior to the first contact end 2241 abutting the protruding portion 113, the horizontal projection of the second contact end 2251 along the insertion direction D and the horizontal projection of the protruding portion 113 along the insertion direction D are staggered, thus preventing the second contact end 2251 from scraping the insulating body 1 in the process of inserting into the insulating body 1, preventing the insulating body 1 from generating insulating debris that sticks to the second contact end 2251, and thereby preventing from affecting the stable connection between the second contact end 2251 and the conductor 203. In addition, the deficiency where due to the main body portion 223 is a structure inclined toward the protruding portion 113 and the overall size of the terminal 2 is smaller, such that the main body portion 223 may easily be applied with a downward acting force, affecting the mounting of the terminal 2, and causing the terminal 2 to deform and fail by being applied with an excessive force may be prevented.

(4) In the process for the second contact end 2251 to mate with the conductor 203, a direction of elastic deformation of the main body portion 223 is perpendicular to the plate surface of the base 21. That is, the abutting force from the conductor 203 is applied to the second contact end 2251 makes the main body portion 223 to elastically deform toward the direction of the abutting force, and the direction of elastic deformation is perpendicular to the plate surface of the base 21. Under the same force, an elastic deformation amount of the plate edge of the plate material of the terminal 2 being applied with a force perpendicular to the plate edge is less than an elastic deformation amount of the plate surface of the plate material of the terminal 2 being applied with a force perpendicular to the plate surface. Correspondingly, compared to the elasticity of the direction of elastic deformation perpendicular to the plate edge of the base 21, the elasticity of the direction of elastic deformation perpendicular to the plate surface of the base 21 is better. Thus, the elasticity of the elastic deformation of the elastic arm 22 along the direction perpendicular to the plate surface of the base 21 is better, resulting in a smaller resisting force when the second contact end 2251 is mated with the conductor 203.

(5) The pre-pressurized portion 224 and the contact portion 225 both protrude from one side of a plate edge of the main body portion 223, utilizing the structural strength of the plate edge of the main body portion 223 to strengthen the contact strength of the terminal 2, such that the pre-pressurized portion 224 has sufficient strength to support the terminal 2, preventing the pre-pressurized portion 224 and the contact portion 225 from easily deforming due to the abutting force from the protruding portion 113 or the conductor 203. The plate surfaces of the pre-pressurized portion 224 and the contact portion 225 are both parallel to the plate surface of the main body portion 223 to further strengthen the strength of the pre-pressurized portion 224 and the contact portion 225, allowing the pre-pressurized portion 224, the contact portion 225 and the main body portion to be formed integrally by blanking, such that consistency of the force applied to the pre-pressurized portion 224 and the contact portion 225 is better, facilitating the contact stability between the pre-pressurized portion 224 and the contact portion 225.

The movement direction of the first contact end 2241 and the second contact end 2251 is perpendicular to the plate edge of the main body portion 223, such that the direction of the abutting force applied to the first contact end 2241 and the second contact end 2251 from the protruding portion 113 or the conductor 203 is perpendicular to the plate edge of the main body portion 223, and the plate edge of the main body portion 223 is applied with force. In this case, when the main body portion 223 performs elastic deformation, the elastic deformation amount is not excessive. By having the plate surface of the main body portion 223 perpendicular to the plate surface of the extending portion 221, the direction of the abutting force applied to the first contact end 2241 and the second contact end 2251 from the protruding portion 113 or the conductor 203 is perpendicular to the plate surface of the extending portion 221. Compared to the plate edge of the extending portion 221, the elasticity of the plate surface of the extending portion 221 is better, such that the extending portion 221 has better elasticity to increase the elasticity of the elastic arm 22.

(6) The plate surface of the main body portion 223 is opposite and parallel to the plate surface of the base 21 and the plate surface of each fixing portion 23 respectively, such that in the process of signal transmission, when the signal is transmitted along the main body portion 223, the base 21 and the positioning portions 23, the signal transmission direction is consistent and does not change, thus reducing transmission loss, and facilitating the stability and consistency of the signal transmission. The guiding wall 1161 is located farther away from the first wall 111 relative to the second wall 112, thus facilitating the positioning portions 23 to better enter and be positioned in the positioning slot 116, and preventing the positioning portions 23 from detaching from the positioning slot 116.

(7) After the second contact end 2251 is mated with the conductor 203, the conductor 203 generates a downward acting force onto the terminal 2, such that the terminal 2 may easily move downward. By having the pre-pressurized portion 224 and the horizontal projection of the stopping portion 114 along the insertion direction D to partially overlap, the pre-pressurized portion 224 is stopped to prevent the pre-pressurized portion 224 from moving downward along the insertion direction D and causing ill contact between the second contact end 2251 and the conductor 203.

(8) After the second contact end 2251 is mated with the conductor 203, at least a portion of the horizontal projection of the first contact end 2241 along the insertion direction D is located outside the horizontal projection area P, and at least a portion of the horizontal projection of the main body portion 223 along the insertion direction D is located within the horizontal projection area P. In this case, the portion of the first contact end 2241 located outside the horizontal projection area P and the portion of the second contact end 2251 located outside the horizontal projection area P are respectively located at two opposite side of the contour boundary of the fixing portion 24, such that a contact position between the first contact end 2241 and the abutting surface 1131 and a contact position between the second contact end 2251 and the conductor 203 are respectively located at the two opposite sides of the contour boundary of the fixing portion 24. Thus, the acting forces applied to the first contact end 2241 and the second contact end 2251 by the fixing portion 24 along the insertion direction D are relatively balanced, such that after the second contact end 2251 is mated with the conductor 203, the fixing of the terminal 2 are more stable, which does not easily shake, and the contact between the second contact end 2251 and the conductor 203 becomes more stable. Further, the contact position between the second contact end 2251 and the conductor 203 is limited to be within the horizontal projection area P, and the acting force applied to the second contact end 2251 by the fixing portion 24 is larger, such that the contact between the second contact end 2251 and the conductor 203 becomes more stable.

(9) The horizontal projection of the main body portion 223 along the insertion direction D is completely located with the horizontal projection area P, such that the inclined angle of the main body portion 223 is restricted, and the inclined angle does not become too large, thus preventing the second contact end 2251 from being easily in contact with the protruding portion 113 when the terminal 2 is inserted into the insulating body 1, and further preventing the main body portion 223 from easily deforming and breaking the elastic structure of the main body portion 223. Moreover, when the signal is transmitted along the main body portion 223 to the fixing portion 24, consistency of the signal is better, and the signal does not have an excessive wave to affect the signal transmission. In addition, the overall structure of the terminal 2 may be provided smaller, thus saving space, such that the size of the corresponding matching structure may also be provided smaller, satisfying the miniaturization requirement of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with an electronic component having a conductor, the electrical connector comprising:

an insulating body, having an accommodating hole, wherein the accommodating hole has a first wall, and a protruding portion protrudes from the first wall; and a terminal, accommodated in the accommodating hole, wherein the terminal has an elastic arm, the elastic arm has a main body portion, a pre-pressurized portion and a contact portion located above the pre-pressurized portion and configured to mate with the conductor, the pre-pressurized portion and the contact portion both protrude from the main body portion toward one side of the protruding portion, the pre-pressurized portion has a first contact end away from the main body portion, the contact portion has a second contact end away from the main body portion, and the second contact end is located closer to the main body portion than the first contact end;

wherein in a process for the terminal to be inserted into the accommodating hole, and prior to the first contact end abutting the protruding portion, a direction for the terminal to be inserted into the accommodating hole is defined as an insertion direction, and a horizontal projection of the first contact end along the insertion direction at least partially overlaps with a horizontal projection of the protruding portion along the insertion direction and passes beyond a horizontal projection of the second contact end along the insertion direction; and wherein in a process for the first contact end to abut the protruding portion, the main body portion elastically deviates toward a direction away from the protruding portion.

2. The electrical connector according to claim 1, wherein the protruding portion has an abutting surface perpendicular to a protruding direction of the protruding portion, a guiding portion is provided on at least one of the pre-pressurized portion and the first wall, and in the process for the terminal to be inserted into the accommodating hole, and prior to the first contact end abutting the protruding portion, the main body portion inclines upward from bottom thereof toward the protruding portion, and the guiding portion guides the pre-pressurized portion to the abutting surface.

3. The electrical connector according to claim 2, wherein in the process for the terminal to be inserted into the accommodating hole, and prior to the first contact end abutting the protruding portion, the horizontal projection of the second contact end along the insertion direction and the horizontal projection of the protruding portion along the insertion direction are staggered.

4. The electrical connector according to claim 1, wherein the terminal has a base, the main body portion is located above the base, a plate surface of the main body portion bends relative to a plate surface of the base, and in a process for the second contact end to mate with the conductor, a direction of elastic deformation of the main body portion is perpendicular to the plate surface of the base.

5. The electrical connector according to claim 4, wherein the elastic arm has an extending portion extending upward from the plate surface of the base, and a bending portion bending from a side of a plate surface of the extending portion, the plate surface of the main body portion is perpendicular to the plate surface of the extending portion, the pre-pressurized portion and the contact portion both protrude from one side of a plate edge of the main body portion, a plate surface of the pre-pressurized portion and a plate surface of the contact portion are both parallel to the plate surface of the main body portion, and a movement direction of the first contact end and the second contact end is perpendicular to the plate edge of the main body portion.

6. The electrical connector according to claim 1, wherein the accommodating hole has a second wall opposite to the first wall, the terminal has a base, two sides of the base respectively have two positioning portions extending upward and configured to position the terminal, a plate surface of the main body portion is opposite to a plate surface of the base and a plate surface of each of the positioning portions respectively, a bottom surface of the insulating body is upward concavely provided with a positioning slot to accommodate the positioning portions, the positioning slot has a guiding wall, the guiding wall and the second wall are located at a same side of the terminal, and the guiding wall is located farther away from the first wall than the second wall.

7. The electrical connector according to claim 1, wherein the protruding portion has an abutting surface, the second contact end abuts the abutting surface, a lower end of the protruding portion is provided with a stopping portion protruding from the abutting surface, a guiding portion is provided between the stopping portion and the first wall, in the process for the first contact end to abut the protruding portion, the guiding portion guides the pre-pressurized portion to the stopping portion, and then the first contact end is located above the stopping portion and abuts the abutting portion, and after the second contact end mates with the conductor, the pre-pressurized portion and a horizontal projection of the stopping portion along the insertion direction partially overlap to stop the pre-pressurized portion from moving downward.

8. The electrical connector according to claim 1, wherein the terminal has a base and a fixing portion extending downward from the base, the main body portion is located above the base, the fixing portion has a horizontal projection area along the insertion direction, and after the second contact end mates with the conductor, at least a portion of the horizontal projection of the first contact end along the insertion direction is located outside the horizontal projection area, and at least a portion of the horizontal projection of the second contact end along the insertion direction is located within the horizontal projection area.

9. An electrical connector, configured to mate with an electronic component having a conductor, the electrical connector comprising:

an insulating body, having an accommodating hole, wherein the accommodating hole has a first wall, and a protruding portion protrudes from the first wall; and a terminal, accommodated in the accommodating hole, wherein the terminal has an elastic arm, the elastic arm has a main body portion, a pre-pressurized portion and a contact portion located above the pre-pressurized portion and configured to mate with the conductor, the pre-pressurized portion and the contact portion both protrude from the main body portion toward one side of the protruding portion, the pre-pressurized portion has a first contact end away from the main body portion, the contact portion has a second contact end away from the main body portion, and the second contact end is located closer to the main body portion than the first contact end;

wherein in a process for the terminal to be inserted into the accommodating hole, an abutting force applied to the second contact end by the protruding portion prior to the first contact end abutting the protruding portion is less than an abutting force applied to the first contact end in a process for the first contact end to abut the protruding portion.

10. The electrical connector according to claim 9, wherein the protruding portion has an abutting surface perpendicular to a protruding direction of the protruding portion, a guiding portion is provided on at least one of the pre-pressurized portion and the first wall, and in a process for the terminal to be inserted into the accommodating hole, and prior to the first contact end abutting the protruding portion, the main body portion inclines upward from bottom thereof toward the protruding portion, and the guiding portion guides the pre-pressurized portion to the abutting surface.

11. The electrical connector according to claim 10, wherein in the process for the terminal to be inserted into the accommodating hole, and prior to the first contact end abutting the protruding portion, the abutting force by the protruding portion is not applied to the second contact end.

12. The electrical connector according to claim 10, wherein the terminal has a base and a fixing portion extending downward from the base, the main body portion extends upward from the base, a direction for the terminal to be inserted into the accommodating hole is defined as an insertion direction, the fixing portion has a horizontal projection area along the insertion direction, and after the second contact end mates with the conductor, a horizontal projection of the main body portion along the insertion direction is completely located within the horizontal projection area.

* * * * *